US005328051A

United States Patent [19]

Potter et al.

[11] Patent Number: 5,328,051

[45] Date of Patent: Jul. 12, 1994

[54] FOOD SERVING DEVICE

[76] Inventors: Wayne R. Potter; Karen A. Chassé, both of 8229 60th St. Cir. E. #512, Sarasota, Fla. 34243

[21] Appl. No.: 109,406

[22] Filed: Aug. 19, 1993

Related U.S. Application Data

[63] Continuation-in-part of Ser. No. 946,882, Sep. 17, 1992, abandoned.

[51] Int. Cl.[5] ..... B65D 7/00

[52] U.S. Cl. ..... 220/575; 220/501

[58] Field of Search ..... 220/575, 501

[56] References Cited

U.S. PATENT DOCUMENTS

| | | | |
|---|---|---|---|
| D. 176,252 | 12/1955 | Duncan | D44/15 |
| D. 283,096 | 3/1986 | Uhrik | D7/27 |
| D. 298,898 | 12/1988 | Roshau | D7/1 |
| D. 305,846 | 2/1990 | Griffith | D7/555 |
| 876,808 | 1/1908 | Kinert | 220/575 |
| 1,100,298 | 6/1914 | Haas | 220/575 |
| 1,272,996 | 7/1918 | Poschadel | 220/575 |
| 1,520,402 | 12/1924 | Clemans | 220/575 X |
| 2,207,417 | 7/1940 | Smith | 220/575 |
| 2,843,287 | 7/1958 | Finley | 220/20 |
| 4,069,940 | 1/1978 | Naimoli | 220/20 |
| 4,351,444 | 9/1982 | Majewski | 220/20 |
| 4,838,444 | 6/1989 | Bitel | 220/575 X |
| 4,986,433 | 1/1991 | Davis | 220/23.8 |
| 5,209,348 | 5/1993 | Schafer, III | 220/575 X |
| 5,241,835 | 9/1993 | Ascone | 220/501 X |

*Primary Examiner*—Steven M. Pollard

[57] ABSTRACT

A food serving device and method for keeping different food items separated prior to their consumption. The device harnesses gravitational flow to allow desirable or undesirable liquids to flow to a receiving compartment (20). In a preferred embodiment, a cereal bowl (10) maintains the crispness of cereal by keeping the cereal in a separate compartment (12) away from milk or other liquid which is kept in liquid reservoir compartment (26). Liquid from reservoir compartment (26) gravitates through channel (38) to the receiving compartment (20). Cereal is pulled toward the user from the cereal compartment (12) and falls into the awaiting liquid in the receiving compartment (20). Additionally, the cereal in the receiving compartment (20) is geographically confined to limit its dispersement so a spoon can be used to easily scoop out a portion of the cereal and the liquid.

18 Claims, 3 Drawing Sheets

FOOD SERVING DEVICE

This is a continuation-in-part of Ser. No. 07/946,882 filed Sep. 17, 1992, now abandoned.

BACKGROUND

1. Field of the Invention

This invention relates to food serving devices and methods. More particularly, it relates to a cereal bowl for maintaining the integrity of cereal throughout a meal and to a device that permits drainage of liquid.

2. Description of the Prior Art

Cereal, commonly eaten with milk products or substitutes, has a general tendency to become undesirably soggy from prolonged contact with liquid before it is consumed. As a result, many meals are not enjoyable and often times part of the meal is discarded because the user does not want to eat soggy cereal.

Inventors have created several types of bowls and devices to reduce this problem of soggy cereal. However, all of these devices possess drawbacks and none of them are commercially available.

For example, the device shown in U.S. Pat. No. 876,808 to Kinert (1908) has an elevated cereal compartment to keep the cereal up and out of the milk. This device must be tilted to gather the milk. U.S. Pat. No. 1,100,298 to Hass (1914) discloses a kitchen utensil for mixing mayonnaise dressing. U.S. Pat. No. 1,272,996 to Poschadel (1918) shows a divided dish for use with soup or ice cream. The apparatus disclosed in U.S. Pat. No. 1,520,402 to Clemans (1923) includes two compartments, one large and one small, with a low section in the wall between them to facilitate the transfer of cereal between them. U.S. Pat. No. 2,207,417 to Smith (1938) discloses a hopper feed cereal bowl having a tall, elongated shape. U.S. Pat. No. 2,843,287 to Finley (1954) and U.S. Pat. No. Des. 176,252 to Duncan (1955) disclose serving pieces having two compartments with a low section in the wall between them to facilitate the transfer of food between them. U.S. Pat. No. 4,069,940 to Naimoli (1978) discloses a bi-level device with a high quantity of parts involved. U.S. Pat. No. 4,351,444 to Majewski (1982) discloses a bowl with a costly additional item required to tilt the bowl, which increases the chances for spillage. U.S. Pat. No. Des. 283,096 to Uhrik (1986) shows a device having two compartments, one large and one small. U.S. Pat. No. Des. 298,898 to Roshau (1988) shows an elongated bi-level bowl. The device disclosed in U.S. Pat. No. Des. 305,846 to Griffith (1990) has a costly insert. Finally, U.S. Pat. No. 4,986,433 to Davis (1991) discloses a device with two bowls connected by an elongated chute.

Although all of the above mentioned inventions can be used to reduce the problem of cereal becoming soggy, they all suffer from drawbacks:

a) tilting required to gather the milk into a puddle for removal with a spoon;

b) cereal must be raked from a large flat surface;

c) large size, excessive weight, or an odd shape make some difficult to store;

d) some are inherently awkward;

e) many require that a small portion of cereal be placed in a large quantity of liquid. The cereal can then disperse due to a lack of confinement and must be pursued;

f) size, shape, or tilt require many to be abnormally large or else require the cereal and/or liquid to be replenished during the course of the meal due to inadequate or disproportionate volumes;

g) many are costly to produce due to the high quantity of parts;

h) the liquid and cereal are in different compartments and there is no way to measure their quantities in relationship to one another;

i) some enable a user to leisurely eat a bowl of cereal but do not assist in keeping the liquid cool over this extended duration;

j) some of these devices have uncommon shapes;

k) many of these would be difficult, if not impossible, to place in a modern dishwasher, especially for a family with several bowls needing cleaned at the same time.

SUMMARY OF THE INVENTION

The present invention includes a novel bowl having a first compartment, a second compartment, and a third compartment wherein the second compartment has an elevated floor so that liquids flow from it into the third compartment. The elevated-floor compartment is used as a reservoir for liquid that is gravity fed into the third compartment in order to prolong the supply of liquid in that third compartment. Alternatively, the elevated-floor compartment can be used to hold an item as liquid drains from it into the third compartment, i.e. to drain gravy from food, while the first compartment can be used for an ancillary item.

The method of the present invention comprises the steps of serving a solid, such as cereal, and a liquid in the same serving piece and providing for maintenance of the integrity of the solid. This is accomplished by isolating the solid so it is in an easily manipulatable proximity to the liquid and can easily be pulled into a limited amount of the liquid in a confined area to limit dispersement of the solid in the liquid. Additionally, more liquid is gravitationally supplied to the confined area as needed. This method is particularly well suited for maintaining the crispness of cereal by providing a cereal compartment that is dry, a receiving compartment in which to mix cereal with liquid in a confining and easily controllable method just prior to eating, and at least one reservoir in fluid communication with the receiving compartment in such a way as to provide sufficient liquid to last the duration of a meal by means of gravitational flow.

In operation, the cereal compartment is filled with cereal. The receiving compartment and reservoir are filled with milk or other liquid. A spoon is used to pull a quantity of dry, crispy cereal forward into the liquid in the receiving compartment, which can then be promptly removed together and eaten. Accordingly, several objects and advantages of this invention are:

a) providing a bowl which allows liquid to flow to a specified area;

b) providing a bowl which facilitates the gathering of solids for easy manipulation;

c) providing a bowl that is easy to store;

d) providing a bowl that is easy to use;

e) providing a bowl that confines solids in liquid to prevent dispersement for easy retrieval with a spoon;

f) providing a bowl that holds as much cereal and liquid as a common cereal bowl;

g) providing a bowl that is inexpensive to produce, and thus affordable by most consumers;

h) providing a bowl with separate compartments that enables the user to determine how much liquid to use relative to the amount of cereal used;

i) providing a bowl that can be insulated or chilled and that will easily fit into a refrigerator or freezer;

j) providing a bowl that is aesthetically appealing;

k) providing a bowl that easily fits into a modern dishwasher.

The primary object of this invention is to provide a device that maintains the integrity of cereal throughout an entire meal. Further objects and advantages of this invention will become apparent from a consideration of the drawings and ensuing description.

DETAILED DESCRIPTION OF THE PREFERRED EMBODIMENT

Three exemplary embodiments of a cereal bowl 10 of the present invention are illustrated. A first embodiment is illustrated in FIGS. 1 through 6, a second embodiment is illustrated in FIGS. 7 through 12, and a third embodiment is illustrated in FIGS. 13 through 18. Item numbers with the suffix L denote left. Item numbers with the suffix R denote right.

Figure 1:
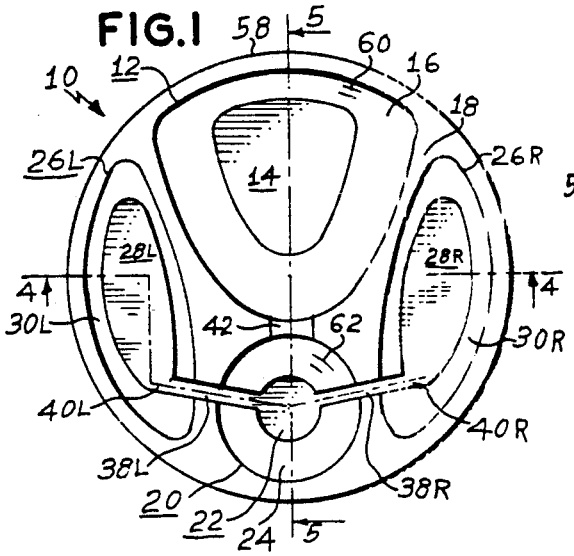
FIG. 1 is a top plan view of an illustrative embodiment of the invention.

FIG. 1 shows bowl 10 which includes a first compartment 12 for retaining cereal having a bottom wall 14 and a side wall 16 that extends upwardly from bottom wall 14 and terminates at an upper end 18. Compartment 12 remains dry at all times so that cereal therein cannot become soggy.

A second compartment 20 for receiving cereal and liquid just prior to consumption has a bottom wall 22 and a side wall 24 that extends upward from bottom wall 22 and terminates at upper end 18. This is the compartment into which cereal is introduced just before it is consumed.

A third and a fourth compartment in the form of a left and right liquid reservoir compartment 26L and 26R each has a bottom wall 28L and 28R respectively, and a sidewall 30L and 30R respectively, that extend upwardly from bottom wall 28L and 28R and which terminate at upper end 18.

Figure 3:
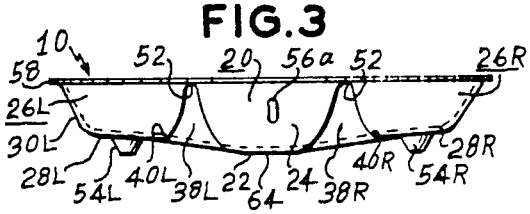
FIG. 3 is a front elevational view.

A rim 58 extends about the perimeter of upper end 18 as shown in FIG. 1 and FIG. 3.

A left and a right liquid transfer channel 38L and 38R connect receiving compartment 20 to reservoir compartments 26L and 26R respectively. As shown in FIG. 3, bottom walls 28L and 28R of reservoir compartments 26L and 26R are at a higher elevation than bottom wall 22 of receiving compartment 20. In addition, reservoir compartments 26L and 26R slope downward from side walls 30L and 30R to a left and a right low point 40L and 40R respectively. Channels 38L and 38R slope from points 40L and 40R respectively, to receiving compartment 20.

A lowered wall section 42 separates cereal compartment 12 from receiving compartment 20 as shown in FIG. 1.

Figure 2:
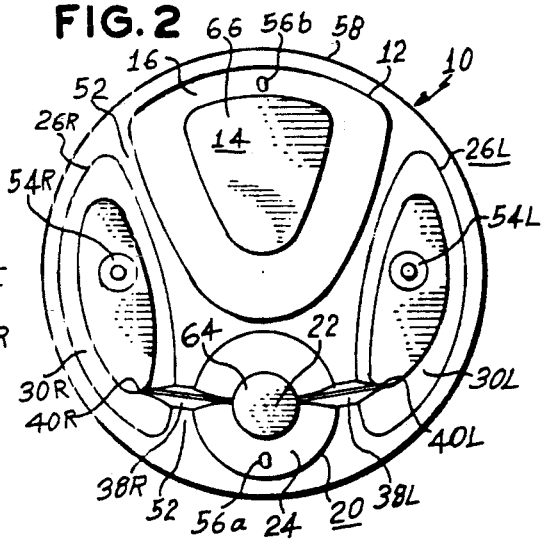
FIG. 2 is a bottom plan view.
Figure 6:
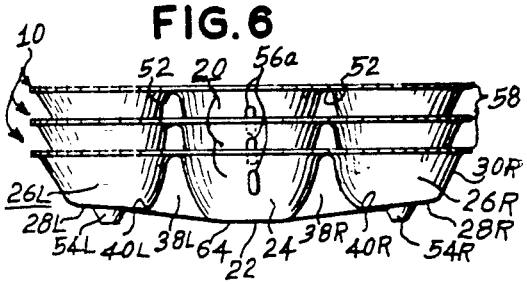
FIG. 6 depicts a nested configuration of the novel bowls.
Figure 4:
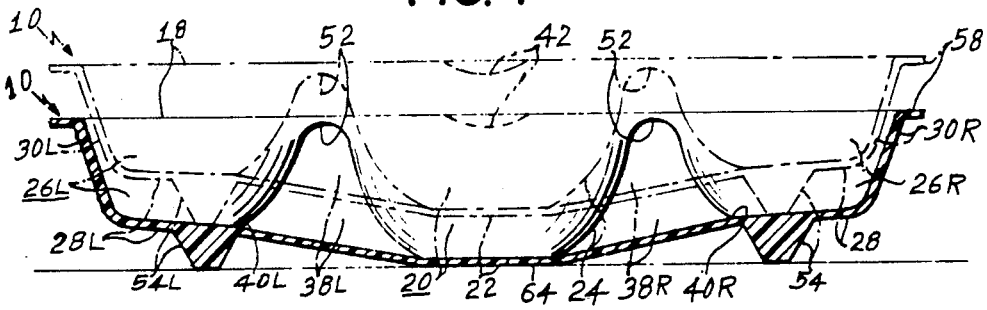
FIG. 4 is a cross sectional view taken along line 4—4 of FIG. 1.

The underside of bowl 10, illustrated in FIG. 2, includes a recessed area 52. This is directly below upper end 18 and enables bowl 10 to be stacked, as shown in FIG. 6, on another bowl 10, which can be stacked on another bowl 10, and so on, reducing the height required to store a plurality of bowls 10.

Figure 5:
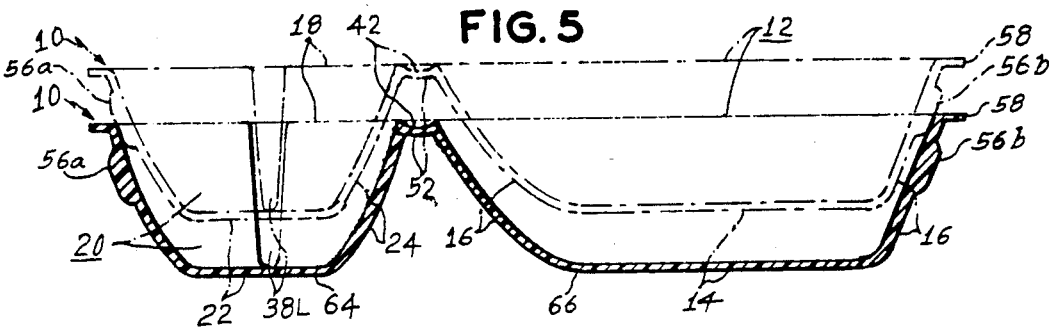
FIG. 5 is a cross sectional view taken along line 5—5 of FIG. 1.
Figure 7:
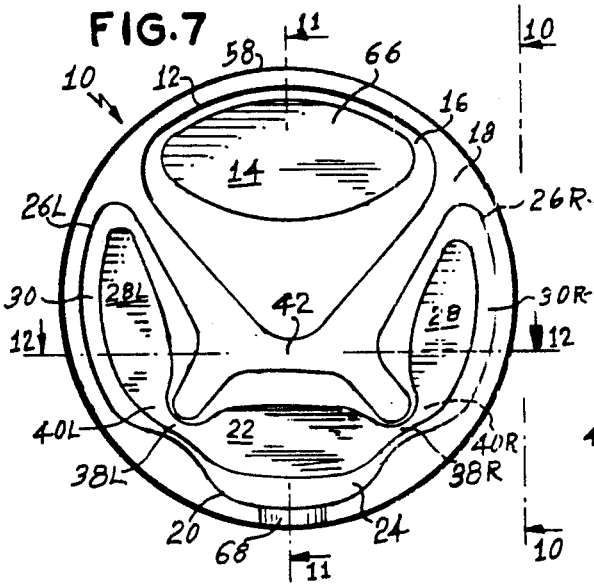
FIG. 7 is a top plan view of a second illustrative embodiment of the invention.
Figure 8:
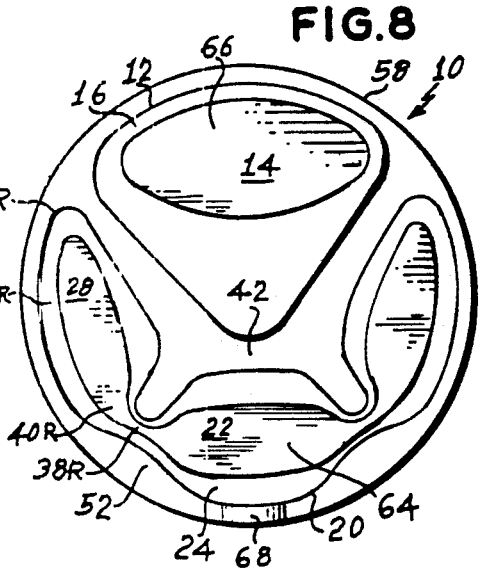
FIG. 8 is a bottom plan view of the second embodiment.

As shown in FIG. 3, a left and a right stabilizing foot 54L and 54R provide stability when bowl 10 is placed on a flat surface such as a table top by extending the underside of reservoir compartments 26L and 26R respectively, making them coplanar with a receiving compartment base 64 and a cereal compartment base 66. FIG. 5 illustrates bases 64 and 66.

As shown in FIG. 5, a front and a rear stacking spacer **56*a* and 56*b* provide stability when a plurality of bowls 10 are stacked together. When stacked, spacers 56*a* and 56*b*, along with feet 54L and 54R, provide congruent points that rest on the next lower bowl 10**.

Cereal level indicium 60 is on side wall 16 and liquid level indicium 62 is on side wall 24. Indicium 62 could alternatively be placed side wall 30L or 30R.

Figure 9:
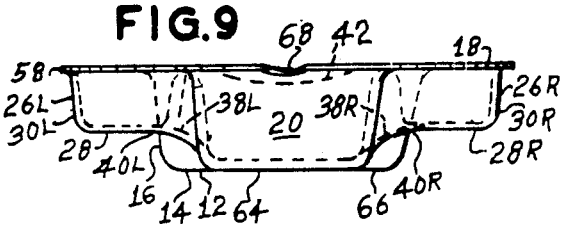
FIG. 9 is a front elevational view of the second embodiment.
Figure 10:
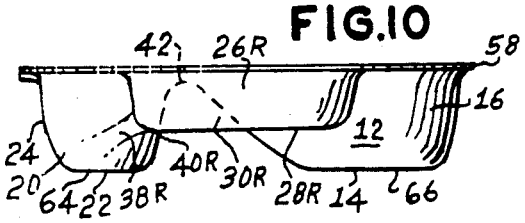
FIG. 10 is a side elevational view taken along line 10—10 of FIG. 7.
Figure 11:
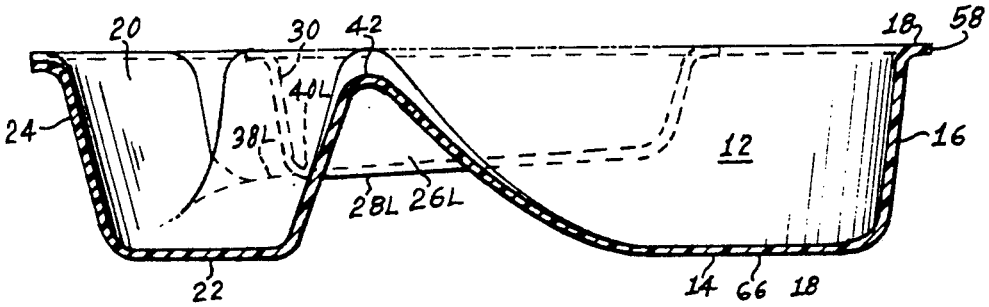
FIG. 11 is a cross sectional view taken along line 11—11 of FIG. 7.
Figure 12:
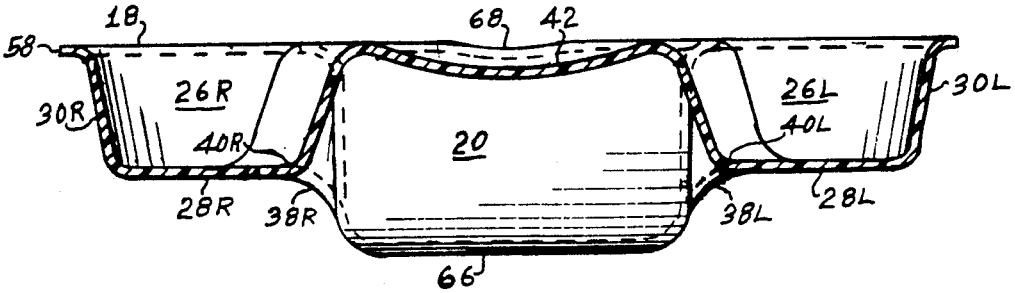
FIG. 12 is a cross sectional view taken along line 12—12 of FIG. 7.
Figure 13:
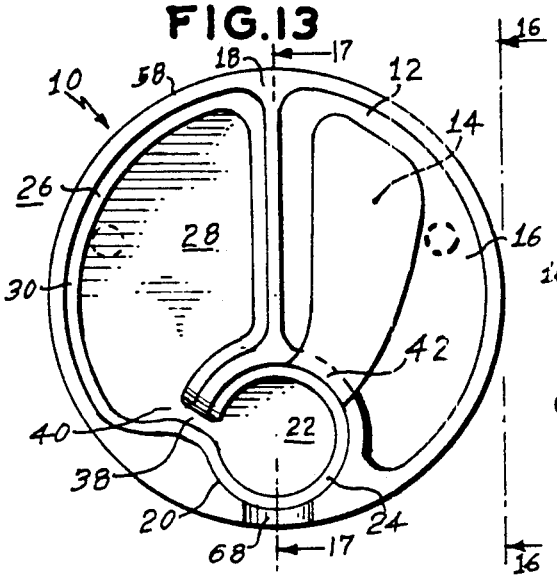
FIG. 13 is a top plan view of a third illustrative embodiment of the invention.
Figure 14:
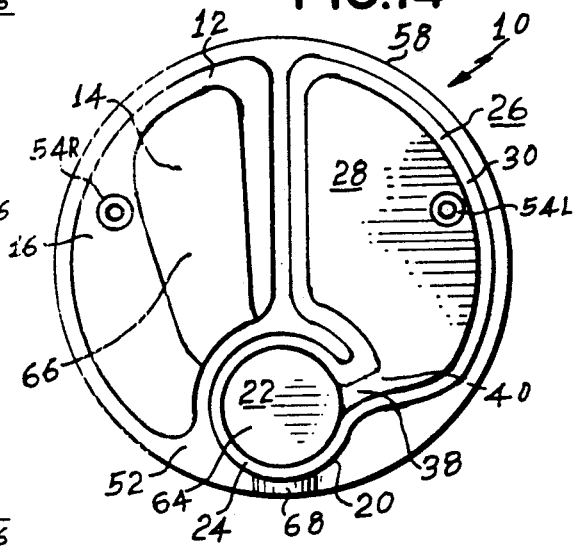
FIG. 14 is a bottom plan view of the third embodiment.
Figure 15:
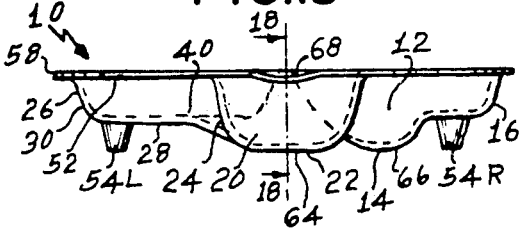
FIG. 15 is a front elevational view of the third embodiment.
Figure 16:
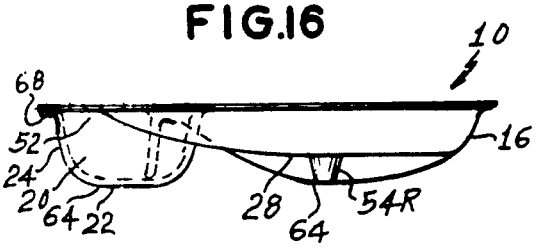
FIG. 16 is a side elevational view taken along line 16—16 of FIG. 13.
Figure 17:
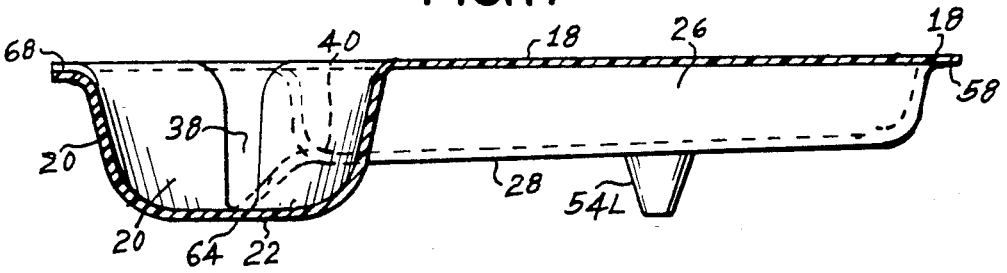
FIG. 17 is a cross sectional view taken along line 17—17 of FIG. 13.
Figure 18:
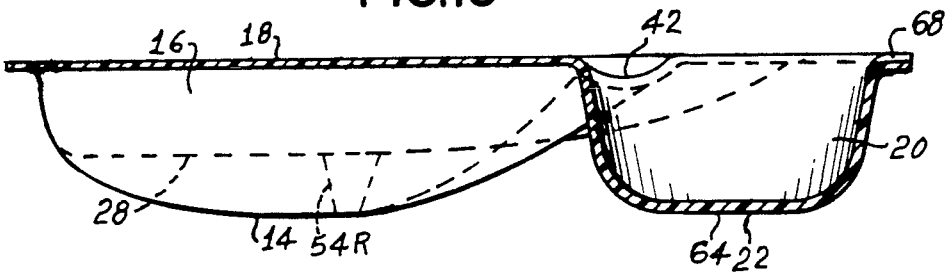
FIG. 18 is a cross sectional view taken along line 18—18 of FIG. 15.

The second embodiment is shown in FIGS. 7, 8, 9, 10, 11, and 12. This embodiment is similar to the aforementioned embodiment, but stabilizing feet 54L and 54R have been eliminated. Instead, receiving compartment base 64 and cereal compartment base 66 have been broadened, as shown in FIG. 9, to provide ample stability. Stacking spacers 56L and 56R have been eliminated, as a plurality of bowls 10 nest together with sufficient stability. Cereal level indicium 60 and liquid level indicium 62 have been eliminated, as the bowl is designed with the correct ratio of the volumes of cereal to liquid for the typical user, and adjustments can easily be judged by the naked eye. Additionally, liquid transfer channels 38L and 38R slope downward from low points 40L and 40R respectively, opening into receiving compartment 20 through side wall 24. Finally, a self-contained drinking spout 68 allows easy drinking of any liquid remaining in the bowl at the end of the meal.

The third embodiment is shown in FIGS. 13, 14, 15, 16, 17, and 18. This embodiment is similar to the first embodiment but right reservoir compartment 26R, right liquid channel 38R, and all associated parts have been eliminated. Instead, left reservoir compartment 26L is large enough to be the only reservoir needed. Stacking spacers 56L and 56R have been eliminated, as a plurality of bowls 10 nest together with sufficient stability. Cereal level indicium 60 and liquid level indicium 62 have been eliminated, as the bowl is designed with the correct ratio of the volumes of cereal to liquid for the typical user. A self-contained drinking spout 68 allows easy drinking of any liquid remaining in the bowl at the end of the meal. This embodiment allows easy manipulation of the cereal by right-handed persons. Accordingly, the opposite scenario allows easy left-handed manipulation for left-handed persons.

A fourth embodiment (not shown) comprises elevating cereal compartment 12 to allow cereal to be pulled directly forward until it falls into receiving compartment 20. This type of embodiment is best suited for certain handicapped individuals so rather than having to manipulate the cereal up side wall 16, the cereal only has to be pulled directly forward.

The method of using cereal bowl 10 is to first put the desired amount of cereal into dry cereal compartment 12. Next, milk or other liquid is added to receiving compartment 20 and reservoir compartment(s) 26. It is only necessary to pour liquid into receiving compartment 20 since channel(s) 38 allow reservoir compartment(s) 26 to attain a common level of liquid with receiving compartment 20.

Using a suitable utensil such as a spoon, a quantity of crispy cereal is pulled from cereal compartment 12 forward (i.e., towards the user) over lowered wall section 42. Although section 42 does not have to be lower than the remainder of the wall, its reduced height allows the cereal to easily fall into the liquid in receiving compartment 20, where it is contained and is readily available. Forces attempting to disperse the cereal from receiving compartment 20 into reservoir compartment(s) 26 are constrained by the narrowness of channel(s) 38. Instead of a narrow channel, other liquid transfer means can be used to permit transfer of liquids but restrict passage of cereal, including but not limited to a tubular channel, a screen, a porous material, a slat or slats, and the like.

Next, the cereal in receiving compartment 20 is eaten before it becomes soggy. While the user is chewing the crispy cereal, the cycle is repeated. An additional quantity of cereal is again moved with a spoon from cereal compartment 12 over section 42. The cereal falls into the liquid in receiving compartment 20, where it is contained and is readily available for eating. This process is continued until the liquid and cereal are depleted. If either is depleted before the other, the next time bowl 10 is filled for consumption, the proper adjustments are made, using indicia 60 and 62, or the naked eye. If desired, any remaining liquid can be drunk from bowl 10 by utilizing self-contained drinking spout 68.

As depletion of the liquid occurs, reservoir compartment(s) 26 become empty before receiving compartment 20. The liquid gravitates from reservoir compartment(s) 26 which has elevated bottom wall(s) 28, to receiving compartment 20. As a result, liquid will be readily available in receiving compartment 20 until the meal is finished.

As the volume of cereal in compartment 12 decreases, the remaining cereal will continue to be easily pulled forward because the shape and slopes of cereal compartment 12 facilitate easy manipulation.

Due to the size and shape of bowl 10, it is easy to store. Additionally, as shown in FIG. 6, a plurality of bowls 10 can be stored by stacking them on top of one another, as they nest with one another as conventional bowls do.

The manner of using this food serving device and method to allow desirable or undesirable liquids to flow to a distinct location includes step of placing the item or items to be drained in compartment(s) 26. Liquids gravitate to low point(s) 40, then through channel(s) 38 and into receiving compartment 20. Items desired to be kept isolated are placed in compartment 12.

While the preceding descriptions contain many specificities, these should not be construed as limiting the scope of the invention but as examples of the presently preferred embodiments of the invention. Many variations are possible, including adding a high circumferential wall to help prevent spillage. Also, additional compartments or shelves can be added to hold fruit, additional types of cereal, etc. in an easily accessible proximity. The cereal bowl can even be constructed to internally contain another medium to enhance the cooling properties if the bowl is chilled or frozen. The shape of the bowl can be enhanced even more, i.e. the compartments can be shaped to resemble figures, animals, cartoon characters, etc. The size of the bowl can be changed to accommodate different appetites. This device can even be adapted to other uses, such as for other meals and food types to keep different food items separated, and even to allow liquids to flow to a receiving compartment, where they can be kept separate, i.e., to allow gravy to drain from a food item to assist in avoiding undesirable consumption.

Therefore, the embodiments of this food serving device and method, providing for the serving of crispy cereal with liquid, whether the user is eating quickly or leisurely, as well as providing for the draining of liquids, should be understood. Accordingly, the scope of the invention should be determined by the appended claims and their legal equivalents, rather than by the examples provided.

We claim:

1. A bowl that separates dry food from liquid until just prior to consumption, comprising:

a first compartment for retaining dry food;

a second compartment for retaining food and liquid;

an upstanding wall for separating said first compartment from said second compartment;

a third compartment for retaining liquid;

a first liquid transfer means for providing fluid communication between said second compartment and said third compartment; and said third compartment being elevated with respect to said second compartment so that liquid in said third compartment flows without assist through said first liquid transfer means under the influence of gravity into said second compartment;

whereby dry food in said first compartment remains dry until it is moved over said upstanding wall into said second compartment where it is mixed briefly with liquid in said second compartment just prior to its consumption with liquid.

2. The bowl of claim 1, further comprising a peripheral rim that extends about the circumference of said bowl, and further comprising a drinking spout formed in said peripheral rim so that a user of said bowl may drink any remaining liquids from said second compartment after the consumption of all food therefrom.

3. The bowl of claim 1, wherein said transfer means restricts passage of material in excess of a predetermined size.

4. The bowl of claim 1, wherein said transfer means ensures that a volume of liquid in excess of a first predetermined volume placed in said third compartment attains a common level in said second and third compartments.

5. The bowl of claim 1, further comprising a first and a second level-denoting indicia wherein:

said first indicium indicates attainment of a predetermined volume in said first compartment; and said second indicium indicates attainment of a predetermined volume in said second and said third compartments.

6. The bowl of claim 1, wherein said first compartment and said second compartment are disposed at a common elevation.

7. The bowl of claim 6, wherein said second compartment is disposed in close proximity to a user, and said first and third compartments are disposed remote from said user.

8. The bowl of claim 6, wherein said first and second compartments have a first and a second flat base, respectively, that are coplanar with one another and which rest flatly atop a flat support surface.

9. The bowl of claim 8, further comprising a leg member that depends from said first compartment and a leg member that depends from said third compartment, each said leg member having a lowermost end that is coplanar with the respective flat bases of said first and second compartments.

10. The bowl of claim 1, further comprising:

a fourth compartment for retaining liquid only;

a second liquid transfer means for providing fluid communication between said second compartment and said fourth compartment; and said fourth compartment being elevated with respect to said second compartment so that liquid in said fourth compartment flows through said second liquid transfer means under the influence of gravity into said second compartment.

11. The bowl of claim 10, wherein said third and fourth compartments are disposed at a common elevation.

12. The bowl of claim 10, wherein said first and said second liquid transfer means are disposed at a common angle of inclination.

13. The bowl of claim 10, wherein said first compartment and said second compartment are disposed at a common elevation.

14. The bowl of claim 10, wherein said first compartment is disposed remote from a user of said bowl, said second compartment is disposed in close proximity to said user, and said third and fourth compartments are disposed on opposite sides of said first and second compartments.

15. The bowl of claim 10, wherein said first and second compartments have a first and a second flat base, respectively, that are coplanar with one another and which rest flatly atop a flat support surface.

16. The bowl of claim 15, wherein said flat base of said first compartment has a predetermined breadth greater than a predetermined breadth of said flat base of said second compartment.

17. The bowl of claim 15, further comprising a leg member that depends from said third compartment and a leg member that depends from said fourth compartment, said leg members having a lowermost end that is coplanar with respective said flat bases of said first and second compartments.

18. A method for maintaining the integrity of food solids, to be consumed, in a bowl containing liquid comprising the steps of:

providing a dry compartment for retaining food solids;

providing a receiving compartment for mixing food solids and liquids in a confining and controllable method just prior to consumption thereof;

providing at least one reservoir in fluid communication with said receiving compartment providing so that additional liquid as needed flows from said at least one reservoir to said receiving compartment by means of unassisted gravitational flow and;

said compartments and said at least one reservoir being an integral part of said bowl.

* * * * *